US009951998B2

(12) United States Patent
Bardeleben et al.

(10) Patent No.: US 9,951,998 B2
(45) Date of Patent: Apr. 24, 2018

(54) HEAT EXCHANGER WITH INTEGRATED CO-AXIAL INLET/OUTLET TUBE

(71) Applicant: DANA CANADA CORPORATION, Oakville (CA)

(72) Inventors: Michael Bardeleben, Oakville (CA); Sachin Bhatia, Mississauga (CA)

(73) Assignee: Dana Canada Corporation, Oakville, Ontario (CA)

( * ) Notice: Subject to any disclaimer, the term of this patent is extended or adjusted under 35 U.S.C. 154(b) by 0 days.

(21) Appl. No.: 14/392,387

(22) PCT Filed: Sep. 29, 2014

(86) PCT No.: PCT/CA2014/050931
§ 371 (c)(1),
(2) Date: Mar. 28, 2016

(87) PCT Pub. No.: WO2015/042721
PCT Pub. Date: Apr. 2, 2015

(65) Prior Publication Data

US 2016/0282053 A1 Sep. 29, 2016

Related U.S. Application Data

(60) Provisional application No. 61/884,520, filed on Sep. 30, 2013.

(51) Int. Cl.
*F28F 3/08* (2006.01)
*F28F 9/02* (2006.01)
(Continued)

(52) U.S. Cl.
CPC ..... *F28D 9/005* (2013.01); *F28F 9/0248* (2013.01); *F28F 9/0253* (2013.01);
(Continued)

(58) Field of Classification Search
CPC .... F28F 9/12; F28F 9/0256; F28F 9/04; F28F 9/0248; F28F 9/0253
(Continued)

(56) References Cited

U.S. PATENT DOCUMENTS 3,907,032 A 9/1975 DeGroote et al.
4,276,928 A 7/1981 Blaskowski
(Continued)

FOREIGN PATENT DOCUMENTS

CA 2366332 A1 6/2003
WO WO 2012095531 A1 * 7/2012 ..... B60H 1/00
WO WO 2012105888 A1 * 8/2012 ..... F28D 9/005

OTHER PUBLICATIONS

Canadian Intellectual Property Office, The International Search Report and Written Opinion issued in PCT/CA2014/050931; dated Dec. 15, 2014; 7 pages; Canadian Intellectual Property Office, Gatineau, Quebec, Canada.

*Primary Examiner* — Len Tran
*Assistant Examiner* — Paul Alvare
(74) *Attorney, Agent, or Firm* — Marshall & Melhorn, LLC

(57) ABSTRACT

A multi-pass heat exchanger is provided wherein the heat exchanger is comprised of a plurality of stacked heat exchange plates defining a plurality of alternating first and second fluid channels interconnecting respective pairs of manifolds. At least one of the manifolds in the pairs of manifolds is in the form of an annular manifold structure which divides the heat exchanger into at least a first part and a second part thereby forming at least a two-pass flow path. The annular manifold structure is provided by a generally tubular manifold insert having one end embedded within the manifold. A first annular manifold flow passage communicates with one of the sets of fluid channels in the first part of the heat exchanger and a second, central manifold flow
(Continued)

passage communicates with the corresponding set of fluid channels in the second part of the heat exchanger.

16 Claims, 11 Drawing Sheets

(51) Int. Cl.
*F28D 9/00* (2006.01)
*F28F 9/12* (2006.01)
*F28F 13/12* (2006.01)

(52) U.S. Cl.
CPC ..... *F28F 9/0256* (2013.01); *F28F 9/0258* (2013.01); *F28F 9/12* (2013.01); *F28F 13/12* (2013.01); *F28F 9/027* (2013.01); *F28F 2009/0287* (2013.01)

(58) Field of Classification Search
USPC ..... 165/167, 178
See application file for complete search history.

(56) References Cited

U.S. PATENT DOCUMENTS

| | | | | |
|---|---|---|---|---|
| 4,872,578 | A * | 10/1989 | Fuerschbach | F28D 9/005 165/166 |
| 4,940,085 | A | 7/1990 | Nelson et al. | |
| 5,070,936 | A | 12/1991 | Carroll et al. | |
| 5,997,295 | A | 12/1999 | Mattson et al. | |
| 6,708,730 | B2 * | 3/2004 | Chikuma | B23K 33/00 138/155 |
| 6,889,758 | B2 | 5/2005 | Burgers et al. | |
| 8,225,853 | B2 | 7/2012 | Macri et al. | |
| 8,573,287 | B2 | 11/2013 | Blomgren | |
| 8,899,312 | B2 * | 12/2014 | Bader | F28D 9/005 165/103 |
| 9,093,729 | B2 * | 7/2015 | Wesner | F28D 9/005 |
| 2004/0104009 | A1 | 6/2004 | Xie | |
| 2004/0226692 | A1 | 11/2004 | Lagerstrom et al. | |

* cited by examiner

HEAT EXCHANGER WITH INTEGRATED CO-AXIAL INLET/OUTLET TUBE

CROSS-REFERENCE TO RELATED APPLICATION

This application claims priority to and the benefit of U.S. Provisional Patent Application No. 61/884,520 filed Sep. 30, 2013, the contents of which are incorporated herein by reference.

TECHNICAL FIELD

The invention relates to a heat exchanger, in particular a two-pass heat exchanger having a co-axial inlet/outlet tube integrally mounted within the heat exchanger.

BACKGROUND

Two-pass or multi-pass heat exchangers are known wherein various combinations of different heat exchanger plates are stacked together to create the desired flow pattern through the heat exchanger. In a two-pass heat exchanger, at least one of the fluid paths through the heat exchanger is divided into a first pass and a second pass, the first pass having an inlet manifold for introducing the fluid into the heat exchanger and an intermediate outlet manifold for transferring the fluid from the first pass and into the second pass, the second pass being in fluid communication with a further manifold that directs the fluid out of the heat exchanger after having completed the second pass. Accordingly, three different manifold structures are required in order to create a two-pass flow path, with one of the manifolds, i.e. the inlet manifold for one of the fluids in the heat exchanger, only extending through a portion of the heat exchanger core. Therefore, in order to create a heat exchanger having the desired two-pass flow pattern, different heat exchanger plates are required in order to form the heat exchanger core. Having a number of different plates required to form a heat exchanger increases costs associated with the heat exchanger and also adds to the complexity associated with the manufacturing of the heat exchanger. Accordingly, it is desirable to modify a conventional, single-pass heat exchanger into a two-pass (or multi-pass heat exchanger) without requiring the use of various different heat exchanger plates and without requiring an additional manifold structure.

SUMMARY OF THE PRESENT DISCLOSURE

In accordance with an example embodiment of the disclosure there is provided a heat exchanger, comprising a plurality of stacked heat exchanger plates defining a plurality of alternating first and second fluid channels therebetween forming a heat exchanger core; a pair of first fluid manifolds interconnected by the plurality of first fluid channels for inletting and discharging a first heat exchange fluid to and from the heat exchanger; a pair of second fluid manifolds interconnected by the plurality of second fluid channels for inletting and discharging a second heat exchanger fluid to and from the heat exchanger; wherein one of said manifolds of said pair of either first or second fluid manifolds is an annular manifold structure having an annular first manifold fluid passage extending through a portion of the one of said manifolds in fluid communication with a first set of said first or second fluid passages; and a second manifold fluid passage extending centrally through said annular first manifold fluid passage and fluidly isolated therefrom, the second manifold fluid passage being in fluid communication with a second set of said first or second fluid passages; the annular manifold structure therefore inletting and discharging the same heat exchange fluid to and from the heat exchanger core in a co-axial manner.

In accordance with another example embodiment of the present disclosure there is provided a method of forming a two-pass heat exchanger comprising providing a heat exchanger core comprising a plurality of spaced apart heat exchanger plates defining a plurality of alternating first and second fluid channels therebetween; a pair of first fluid manifolds in communication with said plurality of first fluid channels for directing a first fluid through said heat exchanger; and a pair of second fluid manifolds in communication with said second fluid channels for directing a second fluid through said heat exchanger; providing a manifold insert having an elongated, generally cylindrical body extending between opposed first and second ends, the manifold insert having a diameter less than the diameter of at least one of said manifolds in one of said pairs of manifolds; arranging said manifold insert within the at least one of said manifolds, the first end of said manifold insert being embedded within said heat exchanger and engaging one of said heat exchanger plates thereby dividing the heat exchanger core into a first part and a second part, the second end of the manifold insert extending outwardly from the heat exchanger core; wherein the manifold insert defines an annular first manifold fluid passage between the at least one of said manifolds and the outer surface of said manifold insert, and a second manifold fluid passage within the open interior passage formed by the cylindrical body, the annular first manifold fluid passage being in fluid communication with the one of said plurality of first or second fluid channels in said first part, and wherein the second manifold fluid passage is in fluid communication with the one of said plurality of first or second fluid channels in said second part.

In accordance with another example embodiment of the disclosure there is provided a manifold insert for use in a heat exchanger having corresponding pairs of internal manifolds formed therein, the respective pairs of manifolds coupled together by first and second fluid channels, the manifold insert comprising an elongated generally cylindrical body defining an open interior passage; a first end for sealingly engaging a portion of the interior of one of said manifolds and defining an annular first manifold flow passage between the outer surface of said cylindrical body and the interior surface of said manifold, the first manifold flow passage being fluidly coupled to a portion of said first or second fluid channels; a second end extending out of said manifold for receiving a fluid fitting; and a second manifold flow passage defined by said open interior passage, the second manifold passage being fluidly coupled to a remaining portion of said first or second fluid channels; wherein said manifold insert divides said heat exchanger into a first part and a second part, the first and second parts defining a two-pass flow path.

BRIEF DESCRIPTION OF THE DRAWINGS

Exemplary embodiments of the present disclosure will now be described by way of example with reference to the accompanying drawings, in which.

DETAILED DESCRIPTION OF EXEMPLARY EMBODIMENTS

Reference will now be made in detail to exemplary implementations of the technology. The example embodiments are provided by way of explanation of the technology only and not as a limitation of the technology. It will be apparent to those skilled in the art that various modifications and variations can be made in the present technology. Thus, it is intended that the present technology cover such modifications and variations that come within the scope of the present technology.

Figure 1:
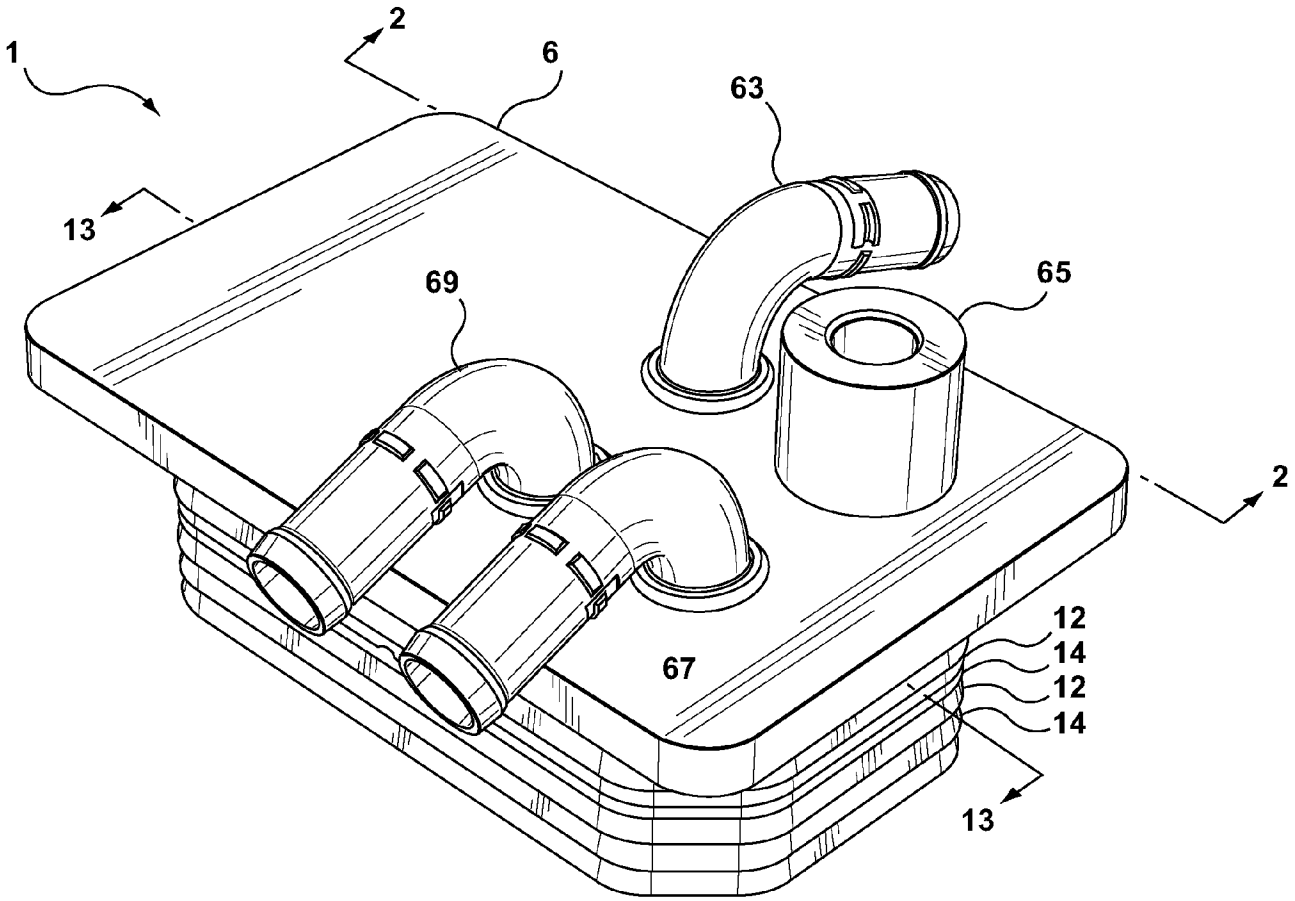
FIG. 1 is a top, perspective view of a heat exchanger according to an example embodiment of the present disclosure.
Figure 4:
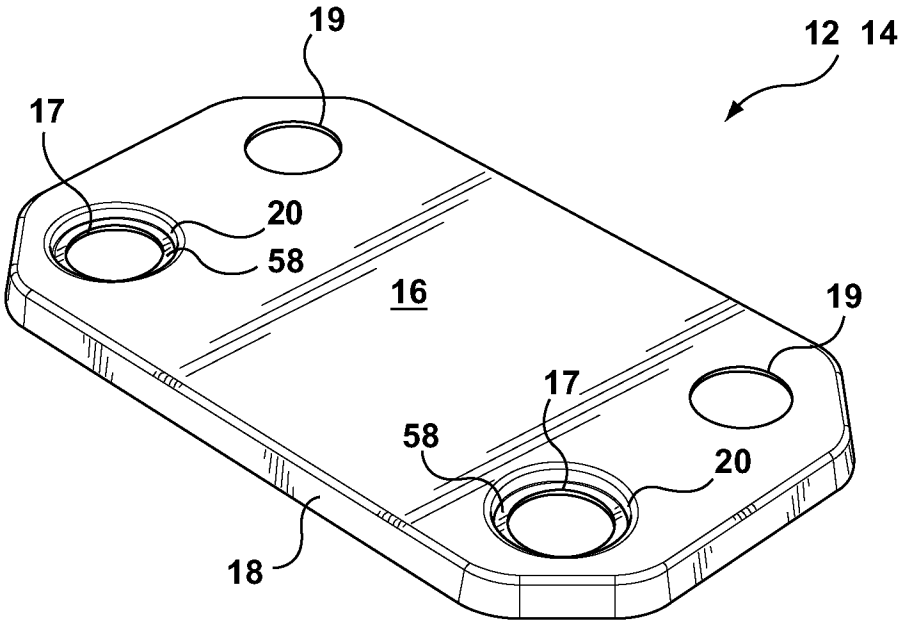
FIG. 4 is a top, perspective view of one of the heat exchanger plates forming the heat exchanger of FIG. 1.
Figure 7:
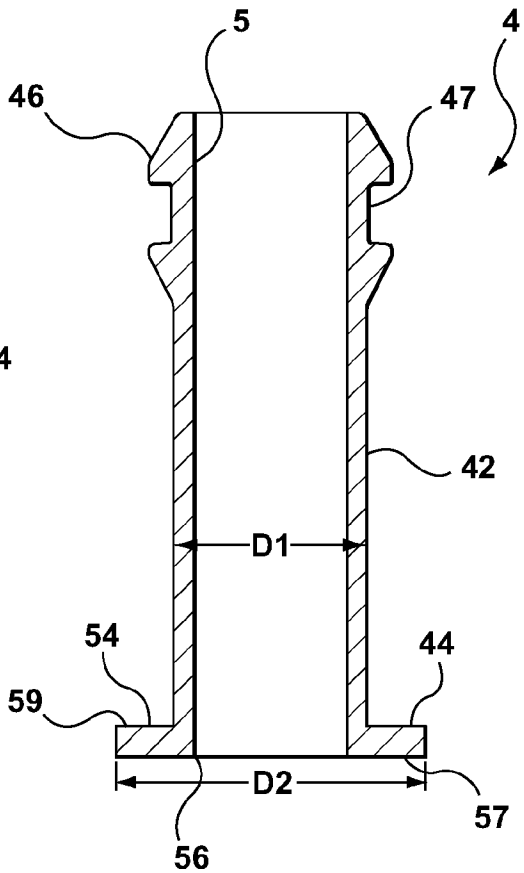
FIG. 7 is a cross-sectional view of the connection insert/tube of FIG. 5 taken along section line 7-7.
Figure 6:
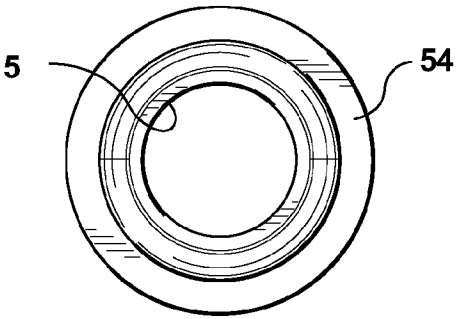
FIG. 6 is a top, end view of the connection insert/tube of FIG. 5.
Figure 5:
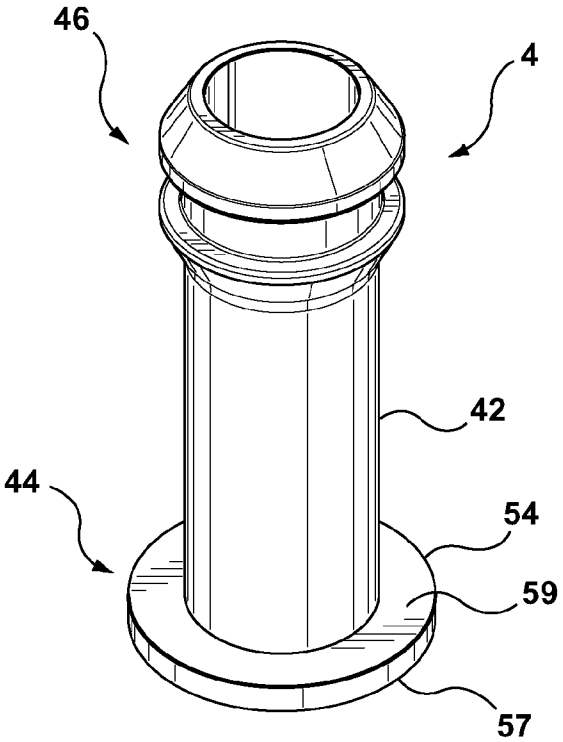
FIG. 5 is a perspective view of a connection insert/tube for use with the heat exchanger shown in FIG. 1.

Referring now to FIG. 1 there is shown an exemplary embodiment of a heat exchanger 10 according to the present disclosure. Heat exchanger 10 is generally in the form of a nested, dished-plate heat exchanger. In the specific embodiment shown, heat exchanger 10 is comprised of a plurality of stamped heat exchanger plates 12, 14 disposed in alternatingly, stacked, brazed relation to one another forming alternating first and second fluid channels or flow passages 13, 15 therebetween. The heat exchanger plates 12, 14 are generally identical to each other with each plate 12, 14 comprising a generally planar base portion 16 surrounded on all sides by a sloping, peripheral wall 18, as shown in FIG. 4. Fluid openings 17, 19 are provided in each of the heat exchanger plates 12, 14 to allow the inlet and outlet of respective first and second heat exchange fluids into the corresponding first and second fluid channels 13, 15 of the heat exchanger 10. Typically, each heat exchanger plate 12, 14 is provided with four fluid openings strategically positioned within the boundary of the base portion 16 of the plates 12, 14, generally one in each of the four corners of the plates 12, 14. Two of the four fluid openings 17 are formed in embossments, generally referred to as bosses or boss portions 20, that are raised (or depressed) out of the plane of the central generally planar base portion 16 of the plate 12, 14, while the other two fluid openings 19 in the plate 12, 14 are formed in and are co-planar with the central, generally planar base portion 16 of the plate 12, 14.

To form the heat exchanger core, heat exchanger plates 12, 14 are stacked one on top of the other with one plate being rotated 180 degrees with respect to the other in nesting arrangement such that the peripheral wall 18 of one plate 12, 14 contacts and seals against the peripheral wall 18 of the adjacent plate 12, 14, and so that the fluid openings 17 formed in the bosses 20 in one plate 12, 14 align with and seal against the flat or co-planar openings 19 of the adjacent plate 12, 14 thereby spacing apart the central base portions 16 of the adjacent plates 12, 14 and defining the alternating first and second fluid passages 13, 15 therebetween. When the plates 12, 14 are stacked so that the peripheral wall 18 is downwardly depending with respect to the central base portion 16, the boss portions 20 associated with two of the fluid openings 17 appear recessed or depressed with respect the central generally planar base portion 16, as shown in FIG. 4.

Turbulizers or any other suitable heat transfer augmentation device 27 (shown schematically in FIGS. 8-11) may be arranged in the first and/or second fluid channels 13, 15 of the heat exchanger 10 in order to increase heat transfer performance of the heat exchanger 10. Alternatively, the central generally planar base portion 16 of the heat exchanger plates 12, 14 may be provided with dimples, ribs, and/or protrusions in order to increase heat transfer performance across the heat exchanger in accordance with principles known in the art.

The aligned fluid openings 17, 19 in the stacked plates 12, 14 form a pair of first fluid manifolds 22, 24 (i.e. a first inlet manifold and a first outlet manifold) coupled together by the first fluid passages 13 for the flow of the first heat exchange fluid through the heat exchanger 10, and form a pair of second fluid manifolds 26, 28 (i.e. a second inlet manifold and a second outlet manifold) coupled together by the second fluid passages 15 for the flow of a second fluid through the heat exchanger 10. For example, depending upon the particular application, one of the first or second heat exchange fluids may be oil (i.e. engine oil or transmission oil) while the other heat exchange fluid may be any suitable coolant, for instance, water. While features of the heat exchanger 10 may be described with reference to the first fluid and/or the first fluid channels 13, it will be understood that the features are equally applicable to the second fluid and the second fluid channels 15, and/or vice versa.

Top and bottom end plates 30, 32 enclose the stack of heat exchanger plates 12, 14 that form the heat exchanger core. Depending upon the particular application and the desired locations of the inlet and outlet fittings 63, 65, 67, 69 for the first and second heat exchange fluids entering/exiting the heat exchanger 10, the end plates 30, 32 are formed with or without fluid openings to allow for suitable inlet and outlet fittings to be arranged on the heat exchanger 10. In the example embodiment shown, the bottom end plate 32 has no fluid openings formed therein and is a solid plate structure that serves to close or seal the end of the heat exchanger 10 since all of the inlet and outlet fittings 63, 65, 67, 69 are arranged on the top end of the heat exchanger 10. The top end plate 30, therefore, is provided with appropriate fluid openings for providing fluid communication between the inlet and outlet fittings and the corresponding inlet and outlet manifolds 26, 28 associated with one of the second heat exchange fluid as will be described in further detail below.

Figure 13:
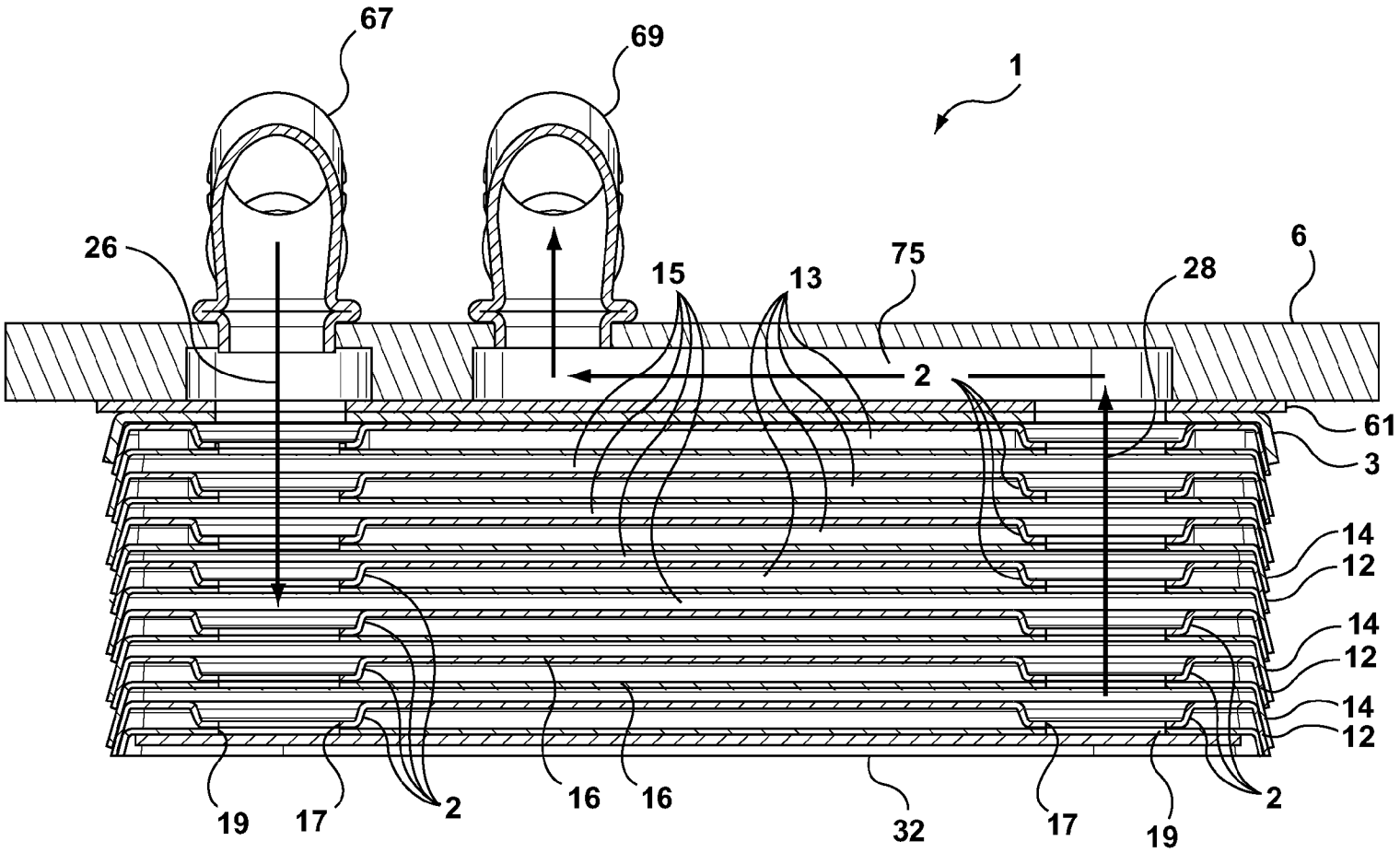
FIG. 13 is a schematic cross-sectional view of the heat exchanger shown in FIG. 1 taken along section line 13-13 illustrating a conventional flow path for a single pass heat exchanger design.
Figure 14:
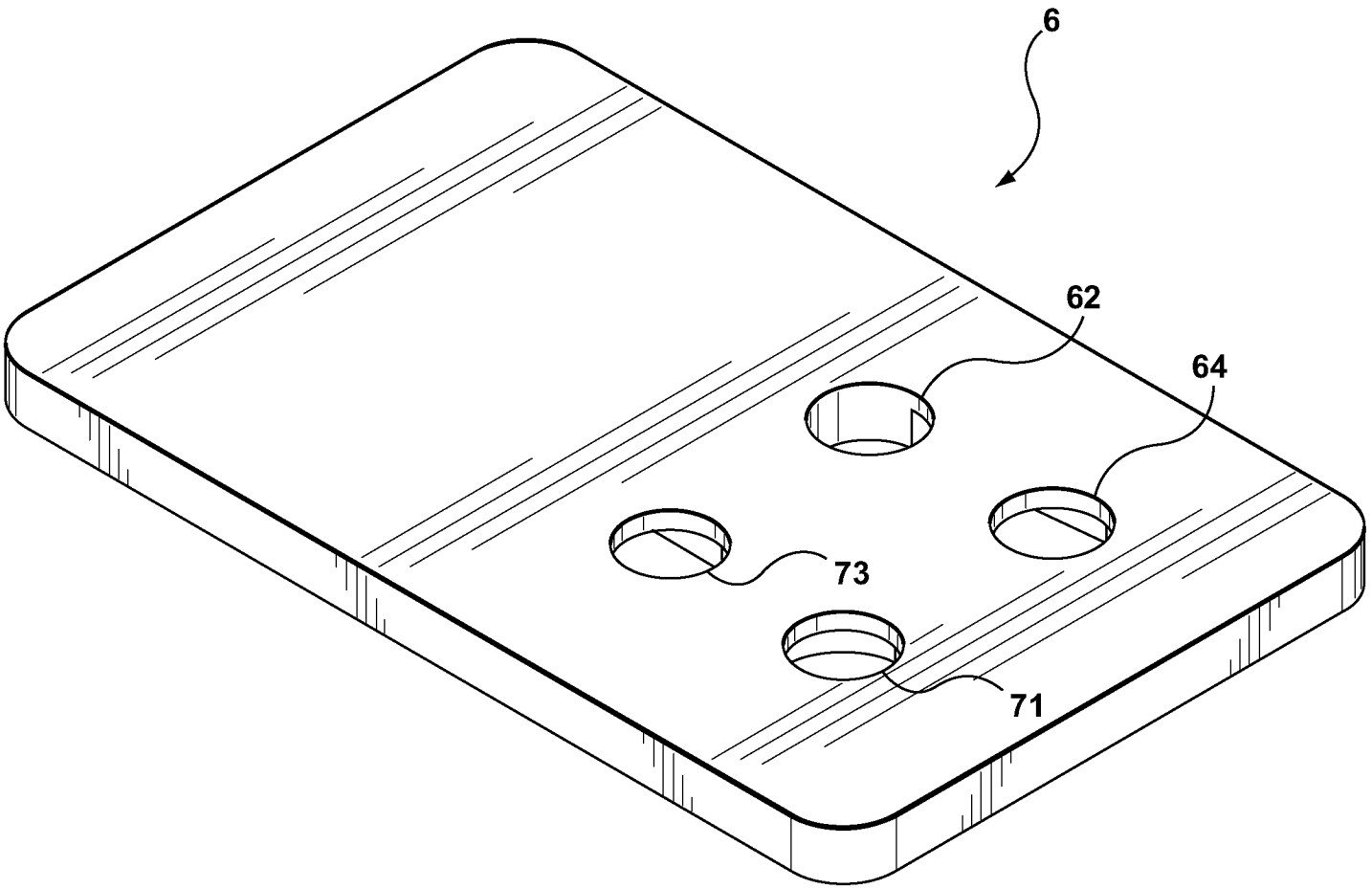
FIG. 14 is a top perspective view of the base plate of the heat exchanger shown in FIG. 1.

In a conventional, single-pass heat exchanger, a first heat exchange fluid would enter the heat exchanger 10 through inlet fitting 63. The fluid would flow though the corresponding inlet manifold and through the plurality of first fluid channels 13. The fluid would then flow through the corresponding outlet manifold and exit the heat exchanger 10 through outlet fitting 65. A second heat exchange fluid would enter the heat exchanger through the second inlet fitting 67 and flow through the corresponding inlet manifold 26 and through the plurality of second fluid channels 15. The second heat exchange fluid would then flow through the corresponding outlet manifold 28 and exit the heat exchanger 10 through outlet fitting 69. The fluid path of the second heat exchange fluid flowing through the heat exchanger 10 is schematically shown in FIG. 13. It is sometimes desirable, however, to increase performance of a heat exchanger by modifying the flow pattern through the heat exchanger for one or both of the fluids flowing therethrough to create a two-pass or multi-pass heat exchanger.

Figure 2:
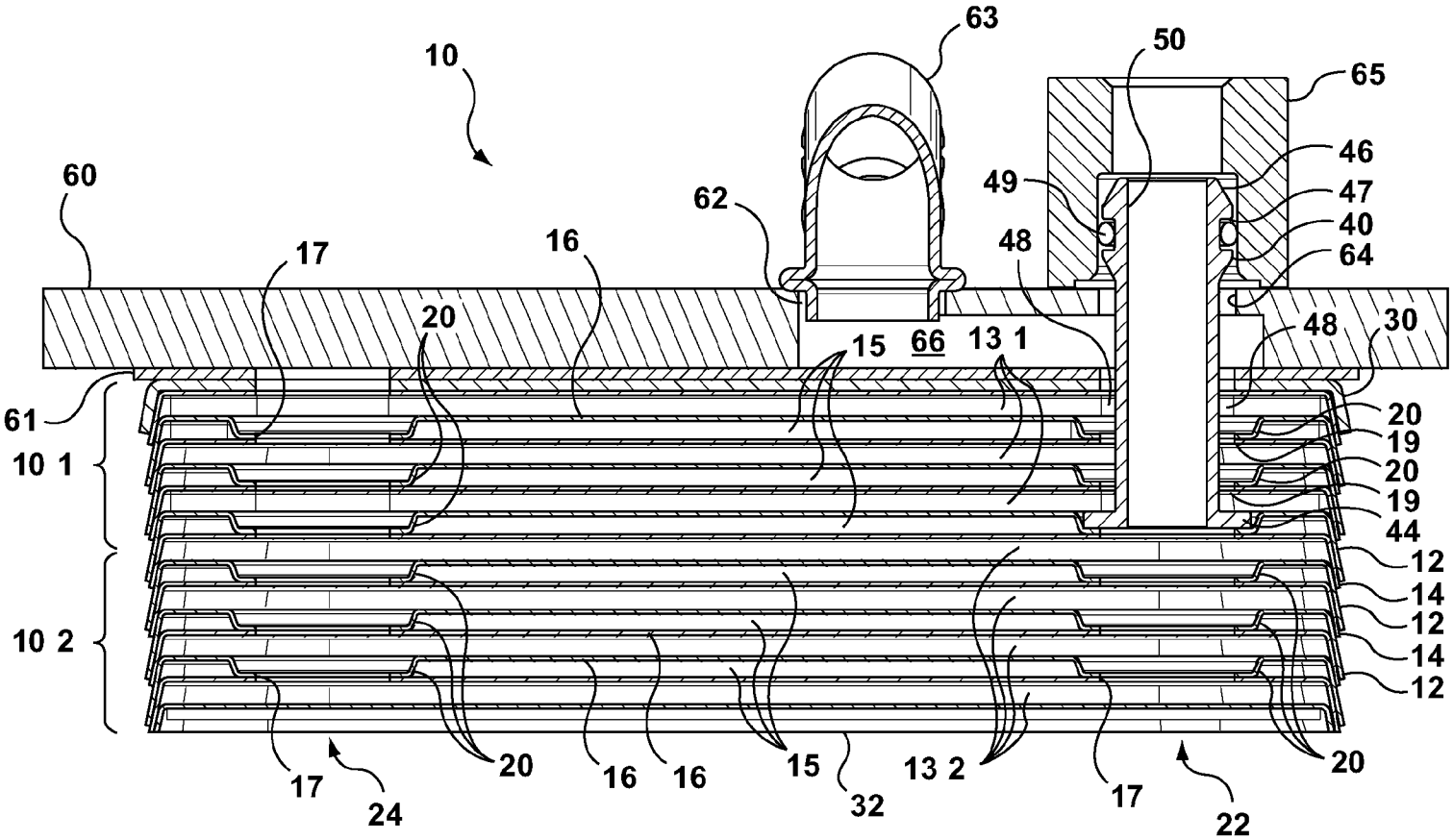
FIG. 2 is a cross-sectional view of the heat exchanger shown in FIG. 1 taken along section line 2-2.
Figure 3:
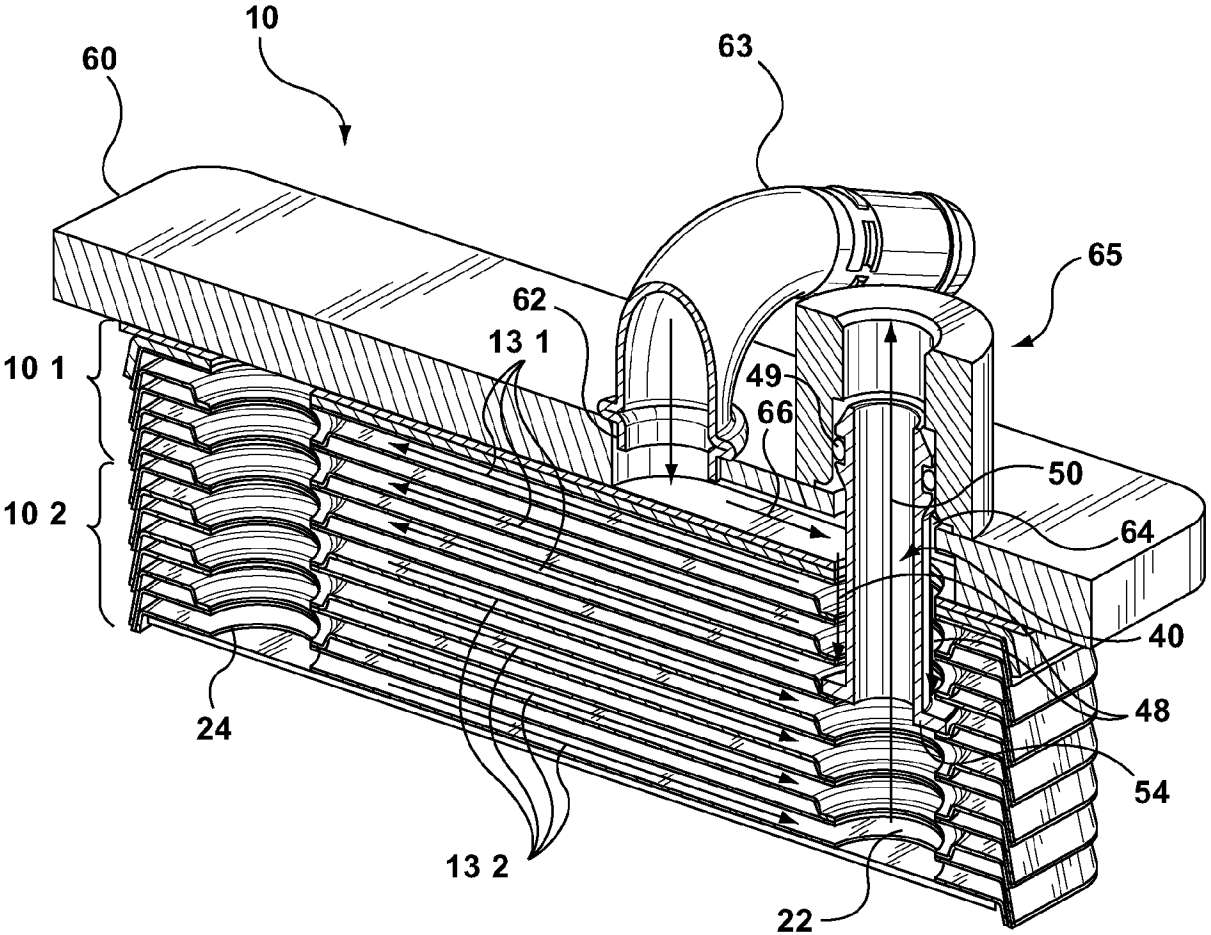
FIG. 3 is a schematic cross-sectional view of the heat exchanger as shown in FIG. 2 illustrating the flow path of one of the fluids flowing through the heat exchanger.

Therefore, in the subject embodiment a connection tube or manifold insert 40 is provided in order to modify the flow pattern through the heat exchanger 10 from a conventional single-pass heat exchanger to a two-pass heat exchanger for at least one of the fluids flowing through the heat exchanger 10. Referring now to FIGS. 2 and 3, the manifold insert 40 is arranged within one of the manifolds of one of the pairs of inlet/outlet manifolds of the heat exchanger 10 and effectively divides the heat exchanger core into a first part 10(1) defining a first pass (i.e. fluid channels 13(1)) for one of the fluids flowing the heat exchanger core, and a second part 10(2) defining a second pass (i.e. fluid channels 13(2)) for the same fluid through the heat exchanger core. For ease of reference, the two-pass fluid path through heat exchanger 10 is described in association with the "first" heat exchanger fluid flowing through the heat exchanger 10. However, it will be understood by those skilled in the art that the features associated with the two-pass are equally applicable to the "second" heat exchange fluid and that various flow patterns can be created for one or both of the first and second heat exchange fluids flowing through the heat exchanger 10 based on the principles described herein.

The manifold insert 40 is in the form of a machined tube having an elongated generally cylindrical body 42 extending between opposed first and second ends 44, 46. The generally cylindrical body 42 has an outer diameter D1 that is less than the diameter of the fluid openings 17, 19 that form the manifold 22 in which the insert 40 is arranged. The first end 44 of the manifold insert 40 is embedded within the associated fluid manifold 22, as shown for instance in FIGS. 2 and 3, and serves to seal off a portion of the manifold 22 from the flow of first fluid (or second fluid) into the heat exchanger 10. The second end 46 of the manifold insert 40 extends out of the heat exchanger 10, the second end 46 being adapted to receive or couple with an appropriate fluid fitting 63 and serves to allow fluid to both enter and exit the heat exchanger 10 through the same manifold opening. The manifold insert 40, therefore, creates an annular header within the fluid manifold 22 in the first part 10(1) of the heat exchanger core by providing an annular first manifold flow passage 48 formed by the gap between the outer surface (or outer diameter D1) of the cylindrical body 42 that forms the insert 40 and the aligned edges of the fluid openings 17, 19 that form the manifold 22, and a second manifold flow passage 50 defined by the central, internal passage defined by the cylindrical body 42 of the insert 40. The annular first manifold flow passage 48 formed by the manifold insert 40 is in fluid communication with the first fluid channels 13 formed by plates 12, 14 within the first part 10(1) of the heat exchanger core, i.e. first fluid channels 13(1), as shown schematically by the flow arrows included in FIG. 3, while the second manifold flow passage 50 formed by the manifold insert 40 is fluidly coupled to the plurality of first fluid channels 13 formed by plates 12, 14 in the second part 10(2) of the heat exchanger core, i.e. first fluid channels 13(2), as shown schematically by the flow arrows included in FIG. 3. Therefore, in the subject embodiment, at least one of the first and second fluids flowing through the heat exchanger 10 enters and exits the heat exchanger through the same manifold structure, the heat exchanger 10 therefore having a co-axial inlet/outlet manifold formed therein.

Figure 8:
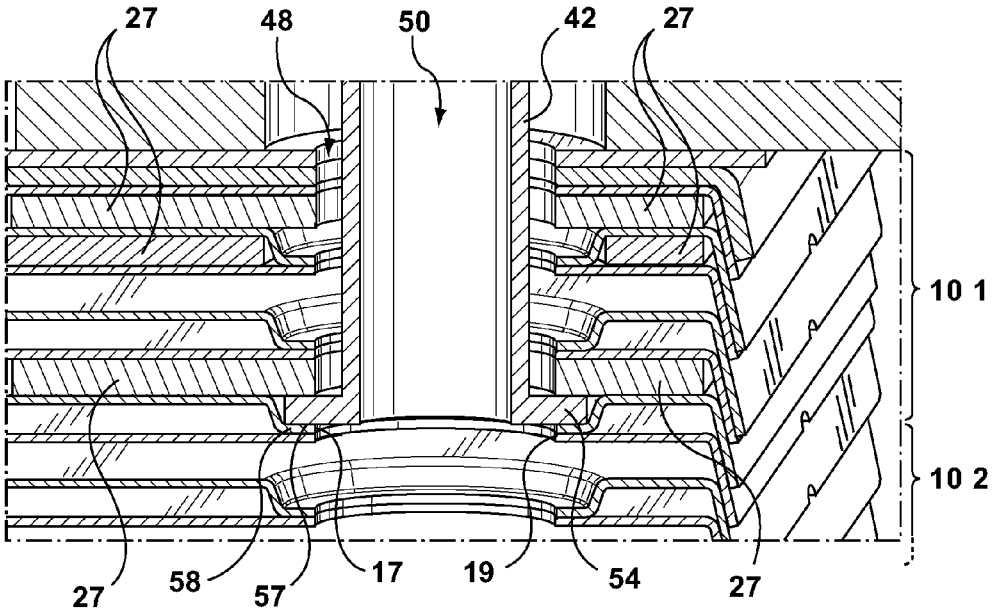
FIG. 8 is a detail view of a portion of the cross-section shown in FIGS. 2 and 3 showing the arrangement of the connection insert/tube within the heat exchanger.

In the example embodiment shown primarily in FIGS. 1-8, the first end 44 of the manifold insert 40 is in the form of a flanged end wherein a flange 54 of material extends radially outwardly from and encircles the open end 56 of the cylindrical body 42. The flange 54 extends radially outwardly from the open end 56 of the cylindrical body so that the overall diameter D2 of the flanged first end 44 is greater than the diameter of the aligned fluid openings 17, 19 that form manifold 22. The flange 54, therefore, provides a bottom surface 57 that abuts and/or rests against the lip of material 58 that surrounds the fluid opening 17 formed by the raised boss portions 20, as shown in FIG. 8. The flange 54, therefore, effectively seals the end of the annular first manifold flow passage 48 formed by the manifold insert 40. By sealing the end of the first manifold flow passage 48, fluid that enters the first fluid passage 48 travels through the manifold 22 only so far as the sealing first end 44 of the manifold insert 40 and then travels through the first fluid channels 13(1) formed by the stacked plates 12, 14 that are in fluid communication with the annular fluid passage 48. The fluid, therefore, travels through the annular inlet passage 48, through the first fluid channels 13(1) in the first part 10(1) of the heat exchanger core to the corresponding fluid manifold 24 at the opposed end of the heat exchanger 10. The fluid then travels from the first part 10(1) of the heat exchanger 10 into the second part 10(2) of the heat exchanger 12 by means of manifold 24 and travels through corresponding first fluid channels 13(2) in the second part 10(2) of the heat exchanger 10 in the opposite direction to the direction of flow in the first part 10(1), thereby creating a second pass of the fluid through the heat exchanger 10. Once the fluid has completed the second pass through fluid channels 13(2) in the second part 10(2) of the heat exchanger 10, the fluid exits the heat exchanger 10 via the portion of manifold 22 in the second part 10(2) of the heat exchanger and through the second manifold flow passage 50 formed by the central passage through the manifold insert 40 and is directed elsewhere in the overall system through the appropriate fluid outlet fitting 65. The second end 46 of the manifold insert 40 is adapted to sealingly engage with an appropriate fluid outlet fitting 65 for directing the fluid away from the heat exchanger 10, the manifold insert 40 and outlet fitting form a fluid tight connection therebetween. In some embodiments, the second end 46 of the manifold insert 40 is formed with at least one groove 47 in the outer surface thereof for receiving any suitable sealing means, such as an O-ring, 49 for sealing against the inner surface of the fitting 65, see for instance FIG. 2.

An adapter or base plate 60 is arranged at one end of the heat exchanger 10 in abutting relationship to either the top or bottom end plate 30, 32, depending upon the location of the fluid inlet/outlet fittings 63, 65, 67, 69. In the embodiment shown in FIG. 1, the base plate 60 is arranged at the top end of the heat exchanger 10 and therefore is positioned on top of end plate 30. An intermediate shim plate 61 may be positioned between the end plate 30 and base plate 60 for attaching the two components together when the entire assembly is brazed together to form the heat exchanger 10. The base plate 60 is generally thicker than the plurality of heat exchanger plates 12, 14 that form the heat exchanger core and generally extends beyond the footprint defined by the heat exchanger 10 to provide sufficient area around the periphery of the heat exchanger 10 to allow for mounting holes to be provided at required locations, if necessary. The base plate 60 also has appropriate fluid openings formed therein so as to provide fluid communication between the various fluid inlet/outlet fittings 63, 65, 67, 69 that are provided and the corresponding inlet and outlet manifolds 22, 24, 26, 28 for each of the first and second heat exchange fluids. More specifically, in the subject embodiment two fluid openings 62, 64 are formed in the base plate 60 so as to provide fluid communication between the corresponding fluid inlet/outlet fittings 63, 65 and the corresponding heat exchanger manifolds 22, 24 for the first fluid, and two fluid openings 71, 72 are formed in the base plate 60 to provide fluid communication between the corresponding fluid inlet/outlet fittings 67, 69 and the corresponding heat exchanger manifolds 26, 28 for the second fluid.

Figure 15:
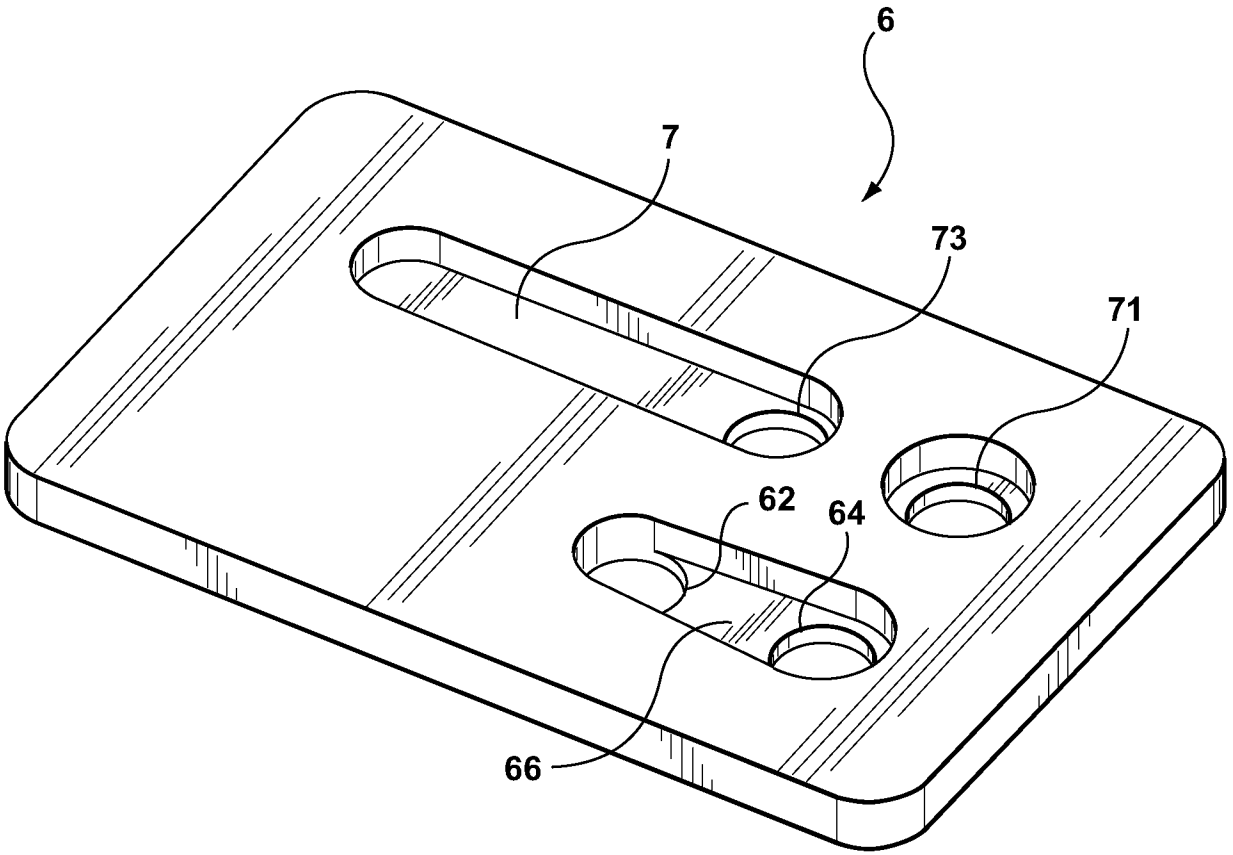
FIG. 15 is a bottom perspective view of the base plate of FIG. 14.

In the subject embodiment, since one manifold (i.e. manifold 22) acts as both the inlet manifold and the outlet manifold for one of the fluids flowing through the heat exchanger as a result of the manifold insert 40, a fluid transfer channel 66 is provided in base plate 60 which directs fluid entering the heat exchanger 10 through inlet fitting 63 and opening 62 to the open end of the annular fluid inlet passage 48 formed by the manifold insert 40 (see FIG. 3). Opening 64 in the base plate 60 is adapted to receive the second end 46 of the manifold insert 40 for establishing fluid communication between the open second end 44 of the manifold insert 40 and the corresponding outlet fitting 65. A second fluid transfer channel 75 is formed in base plate 60 for directing the second heat exchange fluid from outlet manifold 28 to the corresponding outlet fitting 69, as shown in FIG. 15. It will be understood, however, that the structure of the base plate 60 and the number/location of fluid openings and fluid transfer channels provided may vary depending upon the desired location of the inlet/outlet fittings.

While individual inlet and outlet fittings 63, 65 have been shown, it will be understood that any suitable fitting may be used to direct fluids into and out of the heat exchanger 10. For instance, in some embodiments, a combined inlet/outlet fitting may be used wherein the fitting itself incorporates fluid inlet and fluid outlet passageways that communicate with the corresponding fluid manifolds in the heat exchanger 10.

Referring now to FIGS. 8-11, various alternate embodiments of the manifold insert 40 will be described in further detail. FIG. 8 shows a detail view of the first end 44 of the manifold insert 40 described above in connection with FIGS. 1-7. As shown, flange 54 surrounds the open first end 44 of the manifold insert 40, the bottom surface 57 of which sits or rest on lip 58 of material that surrounds fluid opening 17 in the formed bosses 20 of the plates 12, 14. The surface contact between the bottom surface 57 of the flange 54 provides adequate contact to ensure that the manifold insert 40 and heat exchanger plates 12, 14 are fixed or sealed together by brazing or any other suitable means.

Figure 9:
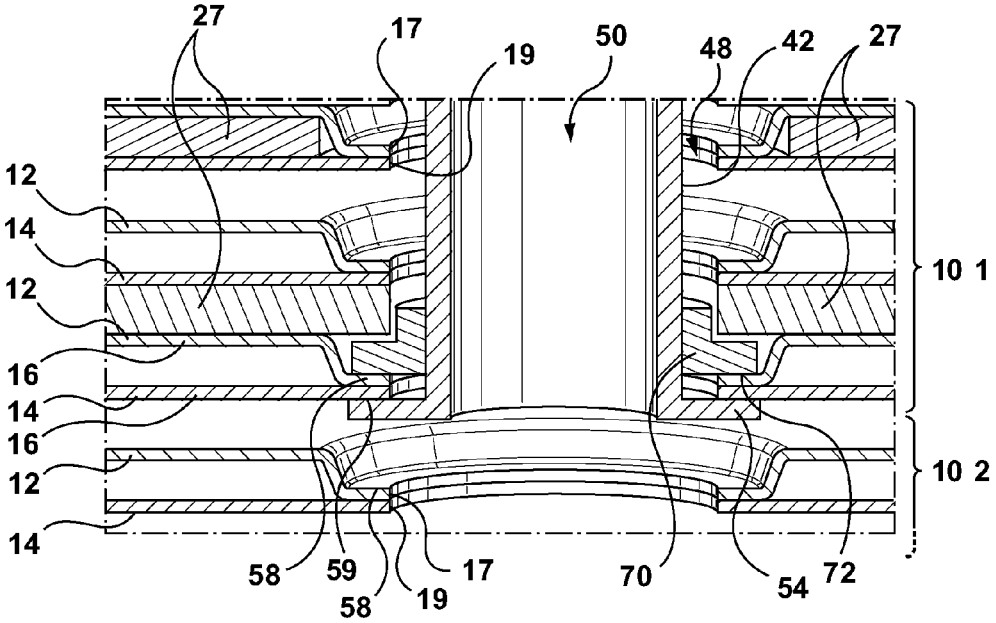
FIG. 9 is a detail view as shown in FIG. 8 illustrating an alternate embodiment of the connection insert/tube.

FIG. 9 shows an alternate embodiment of the manifold insert 40 wherein the manifold insert 40 is arranged so that the upper surface 59 of the flange 54 contacts and is in abutting relationship with the portion of the central generally planar base portion 16 of the plate 12, 14, that surrounds the flat fluid openings 19. A machined cap or collar 70 is positioned on the manifold insert 40 at the first end 44 thereof, the collar 70 being sized to have an interference or fluid tight fit around the first end 44 of the manifold insert 40. The collar 70 is formed with a flanged base 72 which rests on and is affixed to the lip 58 of material surrounding the fluid opening 17 in the bosses 20. Therefore, when the heat exchanger 10 is assembled, the aligned fluid openings 17, 19 of one of the plate pairs 12, 14 are effectively sandwiched between the flanged base 72 of the collar 70 and the flanged first end 44 of the manifold insert 40.

Figure 10:
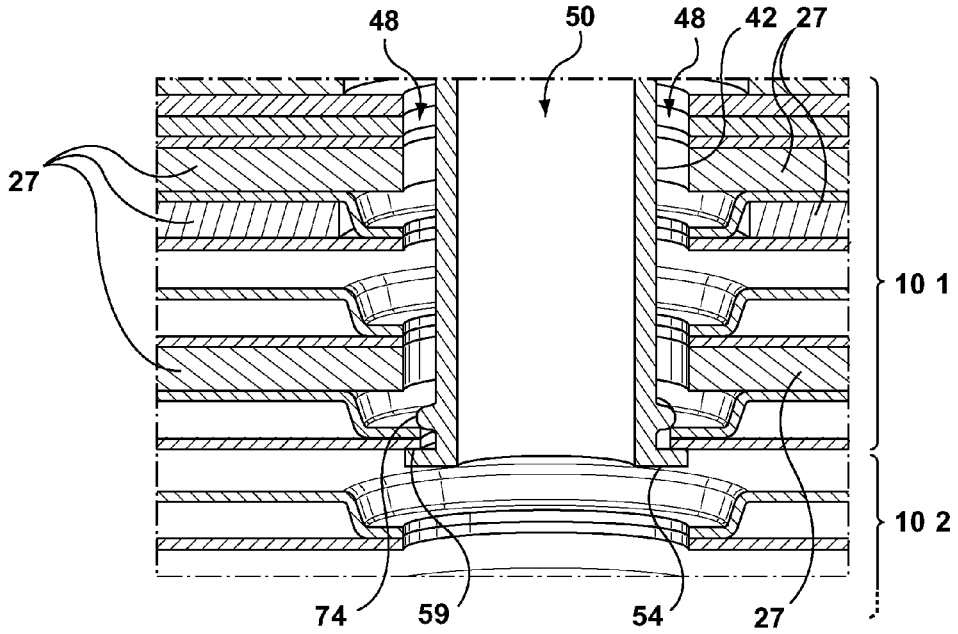
FIG. 10 is a detail view as shown in FIG. 8 illustrating another alternate embodiment of the connection insert/tube.

FIG. 10 illustrates yet another embodiment of the manifold insert 40 wherein the first end 44 of the insert 40 is formed with a circumferential bead 74 that projects radially outwardly from the outer surface of the cylindrical body 42, the bead 74 being slightly spaced apart from the open first end 44 of the manifold insert 40. When the manifold insert 40 is arranged within a portion of the manifold 22, the circumferential bead engages and rests on the lip 58 of material surrounding the fluid opening 17 in the boss portion 20, the end of the manifold insert 40 extending into the fluid opening 17 so that it can be flared outwards thereby creating a flanged end 54. As a result, the mating edges of the aligned fluid openings 17, 19 of the plate pair 12, 14 that divides the heat exchanger core into the first part 10(1) and the second part 10(2) are sandwiched between the upper surface 59 of the flanged end 54 and the circumferential bead 74. By having the mating edges of the aligned fluid openings 17, 19 sandwiched between the flange 54 and the circumferential bead 74, two contact surfaces are provided for fixing and/or sealing the components together, for instance, by brazing.

Figure 11:
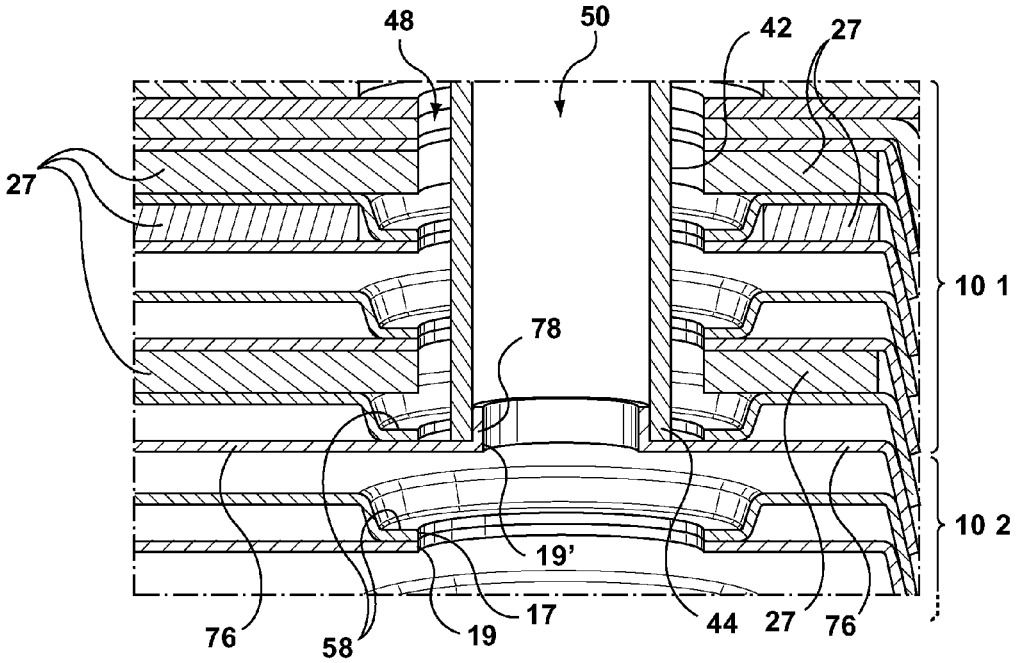
FIG. 11 is a detail view as shown in FIG. 8 illustrating yet another alternate embodiment of the connection insert/tube.

FIG. 11 illustrates a further embodiment of the heat exchanger 10 wherein the manifold insert 10 is in the form of an elongated cylindrical tube or body 42. Rather than having a flange 54 formed at the first end of the cylindrical body 42, a divider plate 76 is arranged within the stack of heat exchanger plates 12, 14 and cooperates with the first end 44 of the manifold insert 40 to divide the heat exchanger 10 into the respective first and second parts 10(1), 10(2). Divider plate 76 generally has the same form as heat exchanger plates 12, 14 and has a central, generally planar base portion 16 surrounded by a downwardly sloping peripheral wall 18. Four fluid openings are formed in the respective corners of the plate 76, two of which are formed in the bosses (not shown) that project out of the plane of the base portion 16 of the plate 76 as in the case of heat exchange plates 12, 14. The other two fluid openings 19 are formed within the plane of the base portion 16 of the plate 76 with one of fluid openings 19' being formed so as to have a smaller diameter than the other fluid openings 17, 19 in the plate 76. The diameter of the fluid opening 19' generally corresponds to the inner diameter of the cylindrical tube or body 42 that forms the manifold insert 40. Fluid opening 19' also comprises a raised circumferential edge 78 that extends away from the opening 19', the circumferential edge 78 being received within the open first end 44 of the manifold insert 40. The manifold insert 40 and fluid opening 19' are sized so as to create a fluid-tight seal between the two components when they are fixed together.

Figure 12:
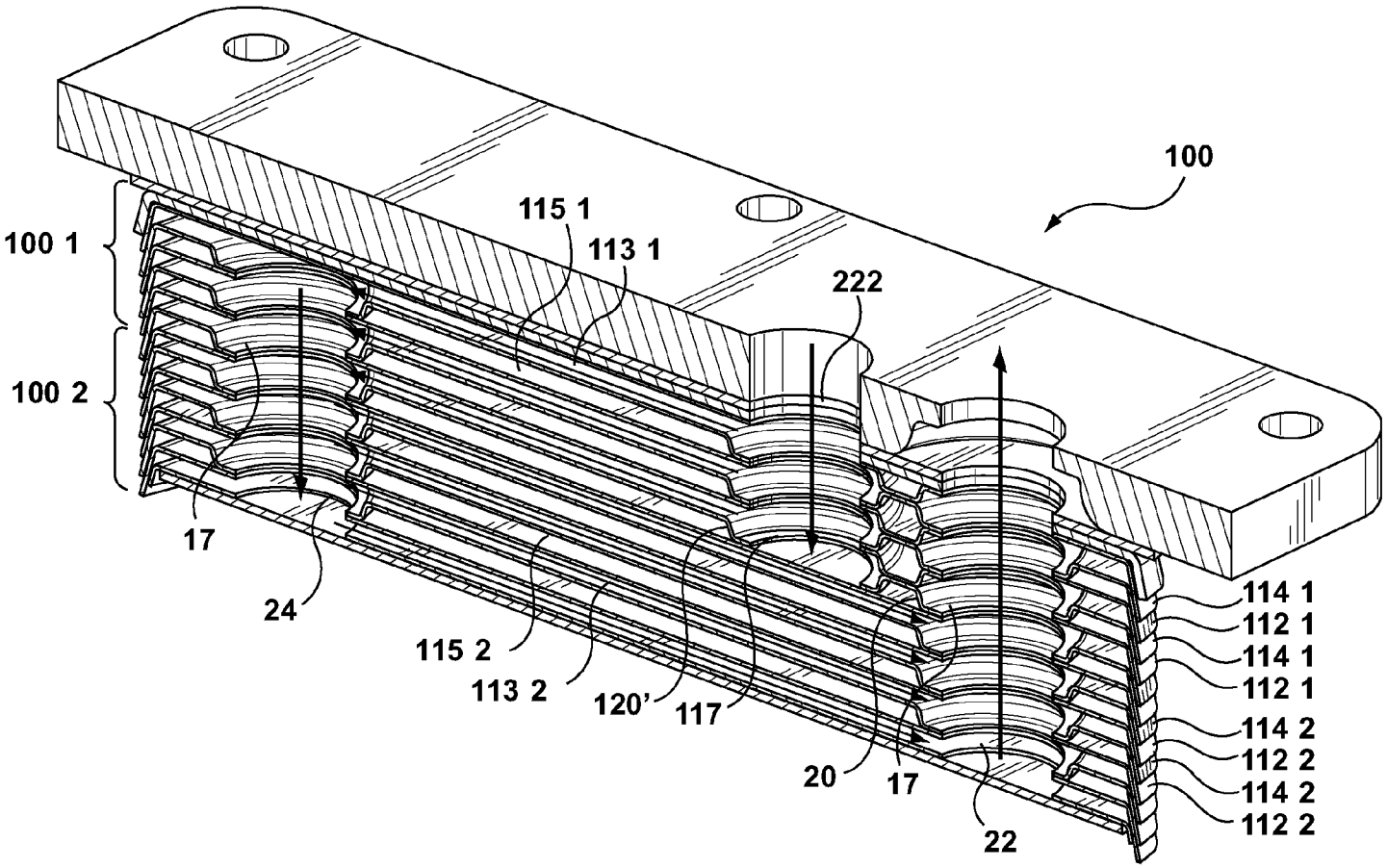
FIG. 12 PRIOR ART
FIG. 12 is a schematic cross-sectional view of a two-pass heat exchanger in accordance with principals known in the art illustrating the flow path of one of the fluids flowing through the heat exchanger.

FIG. 12 illustrates a two-pass heat exchanger 100 in accordance with principles known in the art. In order to achieve the multi-pass flow pattern through the heat exchanger 100, the heat exchanger 100 is comprised of a first portion 100(1) and a second portion 100(2), each of which are comprised of a plurality of stacked heat exchange plates 112(1), 114(1) and 112(2), 114(2). The lower or second portion 100(2) of the heat exchanger is comprised of plates 112(1), 114(1) which are similar in structure to the heat exchanger plates 12, 14 described above in connection with heat exchanger 10. The upper or first portion 100(1) of the heat exchanger is comprised of a different set of heat exchange plates 112(1), 114(1) which are similar to the above-described heat exchanger plates 12, 14, 112(2), 114(2) except that an additional fluid opening 117 formed in an additional boss portion 120' that is arranged proximal to the one of the other boss portions 20. Therefore, when heat exchange plates 112(1), 114(1) are stacked in their alternating relationship to form fluid channels 113(1), 115(1) therebetween, an additional manifold structure 222 is formed adjacent to manifold structure 22. In the embodiment shown in FIG. 12, the additional manifold structure 222 serves as the inlet manifold for delivering fluid to the first fluid channels 113(1) in the first part 100(1) of the heat exchanger 100. The fluid then travels through the first fluid channels 113(1) to the corresponding manifold structure 24 at the opposed end of the fluid channels 113(1) and enters the second part 100(2) of the heat exchanger 100. From manifold structure 24, the fluid travels through fluid channels 113(2) in the second part 100(2) of the heat exchanger 100 to outlet manifold 22 and exits the heat exchanger 100 after having completed the two-passes through fluid channels 113(1), 113(2). Therefore, in order to achieve the desired two-pass flow pattern through the heat exchanger 100, an additional manifold structure 222 is required which requires a different set of heat exchanger plates 112(1), 114(1) when forming the heat exchanger 100. As well, since the length of the first fluid channels 113(1) in the first part 100(1) of the heat exchanger differs from the length of the first fluid channels 113(2) in the second part 100(2) of the heat exchanger, the heat transfer performance over the first pass may differ from the heat transfer performance in the second pass. As well, any heat transfer augmentation devices or surfaces, such as turbulizers, that are arranged inside the fluid channels 113(1) will require a different shape/length than those used in the second part 100(2) of the heat exchanger. A heat exchanger that requires different plate structures and turbulizer structures in order to achieve the desired flow patterns through the heat exchanger adds to both material and manufacturing costs associated with the assembly heat exchanger.

The manifold insert 40 described above in connection with FIGS. 1-11 allows the components of a conventional single-pass heat exchanger structure to be easily modified into a two-pass or multi-pass heat exchanger (depending upon the location/arrangement and number of manifold inserts 40 used) without requiring different heat exchanger plates and/or turbulizer structures. The manifold insert 40 also allows the length of the flow passages for each fluid pass (e.g. fluid pass 10(1), 10(2) to remain generally the same allowing for more consistent fluid profile through the heat exchanger and more consistent performance across the heat exchanger core.

While various exemplary embodiments have been described and shown in the drawings, it will be understood that certain adaptations and modifications of the described exemplary embodiments can be made as construed within the scope of the present disclosure. Therefore, the above discussed embodiments are considered to be illustrative and not restrictive.

What is claimed is:

1. A heat exchanger, comprising:

a plurality of stacked heat exchanger plates defining a plurality of alternating first and second fluid channels therebetween forming a heat exchanger core, wherein each heat exchanger plate comprises:

a base portion;

a peripheral wall extending from and surrounding the base portion, the peripheral wall of one heat exchanger plate sealing against the peripheral wall of the adjacent heat exchanger plate when said plates are stacked together in a nesting relationship;

a pair of boss portions that project out of the plane of the base portion, each boss portion having a fluid opening formed therein; and a pair of fluid openings formed in the plane of the base portion;

wherein the fluid openings in each of the boss portions of one plate align and mate with the fluid openings formed in the plane of the base portion of the adjacent plate, the boss portions spacing apart the adjacent plates;

a pair of first fluid manifolds defined by corresponding pairs of aligned fluid openings formed in the plurality of heat exchanger plates and interconnected by the plurality of first fluid channels for inletting and discharging a first heat exchange fluid to and from the heat exchanger;

a pair of second fluid manifolds defined by corresponding pairs of aligned fluid openings formed in the plurality of heat exchanger plates and interconnected by the plurality of second fluid channels for inletting and discharging a second heat exchanger fluid to and from the heat exchanger;

a manifold insert disposed within one of said manifolds, the manifold insert having an elongated cylindrical body extending between first and second ends and defining an open interior passage and being cooperatively configured within the manifold so as to define an annular manifold fluid passage in fluid communication with a first set of either said first fluid channels or said second fluid channels; and a second manifold fluid passage extending centrally through said open interior passage of said manifold insert and fluidly isolated from said annular manifold fluid passage, the second manifold fluid passage being in fluid communication with a second set of said first fluid channels or said second fluid channels;

the annular manifold structure therefore inletting and discharging the same heat exchange fluid to and from the heat exchanger core in a co-axial manner;

wherein the first end of the manifold insert is disposed within one of said boss portions of said heat exchanger plates associated with a corresponding fluid channel, the first end having a sealing surface for sealing the fluid opening formed in said boss portion thereby closing said annular fluid passage and preventing fluid communication between the annular manifold fluid passage and the adjacent first or second fluid channel, the first sealing end being recessed within the boss portion leaving the corresponding fluid channel unobstructed from the first end of said manifold insert.

2. The heat exchanger as claimed in claim 1, wherein the other manifold in said pair of either first or second fluid manifolds is in fluid communication with said annular manifold fluid passage by means of said first set of either said first fluid channels or said second fluid channels and is also in fluid communication with said second manifold fluid passage by means of said second set of either said first fluid channels or said second fluid channels, said manifold transmitting fluid from said first set of fluid channels to said second set of fluid channels.

3. The heat exchanger as claimed in claim 1, wherein each of said manifolds defines a manifold wall forming a manifold flow passage having a first diameter and extending into said heat exchanger core, the manifold flow passage being in fluid communication with either said first fluid channels or said second fluid channels, wherein the annular manifold flow passage is defined between the manifold wall and the elongated cylindrical body of the manifold insert.

4. The heat exchanger as claimed in claim 3, further comprising:

a base plate having a first side and a second side opposite to said first side, the base plate being affixed to one end of the heat exchanger with the first side contacting and sealing against the end of the heat exchanger;

at least one fluid transfer channel formed in the first side of said base plate and extending between first and second ends wherein the first end is in fluid communication with a fluid port in the second side of the base plate for receiving one of said first or second heat exchanger fluids and the second end is in fluid communication with the annular first manifold flow passage of said annular manifold structure;

wherein the fluid transfer channel directs fluid to said annular manifold flow passage of said annular manifold structure.

5. The heat exchanger as claimed in claim 3 wherein a further manifold insert is arranged within another one of said manifolds.

6. The heat exchanger as claimed in claim 1, wherein said first end of said manifold insert comprises a flanged end, said flanged end defining said sealing surface for engaging and sealing against said boss portion of said heat exchanger plate surrounding said fluid opening and closing an end of said annular manifold fluid passage, wherein the flanged end is disposed within the boss portion.

7. The heat exchanger as claimed in claim 1, wherein said first end of said manifold insert comprises a flanged end and a circumferential bead extending radially away from the outer surface of said cylindrical body spaced apart from said flanged end; wherein said mating boss portions and fluid openings of said mating first and second plates are sandwiched between said circumferential bead and said flanged end thereby closing an end of said annular first manifold fluid passage; the circumferential bead being recessed within the boss portion.

8. The heat exchanger as claimed in claim 6, further comprising a collar positioned around said manifold insert at said first end, the collar being spaced apart from said flanged end and defining a gap therebetween;

wherein a pair of heat exchanger plates are sandwiched between said collar and said flanged end, said collar closing an end of said annular first manifold fluid passage, wherein the collar is disposed within the boss portion.

9. The heat exchanger as claimed in claim 1, further comprising a divider plate positioned within the stack of heat exchanger plates for dividing said heat exchanger into first and second parts corresponding to said first and second sets of said first or second fluid channels, the divider plate having a fluid opening for aligning and mating with the fluid openings forming the one of the manifolds, the fluid opening having a smaller diameter than the fluid openings forming the one of the manifolds and defining a free edge for sealingly engaging with said first end of said manifold insert.

10. The heat exchanger as claimed in claim 1, further comprising heat transfer surfaces positioned within the first and/or second fluid channels.

11. The heat exchanger as claimed in claim 1, wherein said manifold insert defines a two-pass flow path for said corresponding first or second fluid channels.

12. A manifold insert for of a heat exchanger, comprising:

an elongated cylindrical body defining an open interior passage;

a first end for sealingly engaging a portion of an interior of a manifold of the heat exchanger and defining an annular first manifold flow passage between the outer surface of said cylindrical body and the interior surface of said manifold, the first manifold flow passage being fluidly coupled to a first set of heat exchanger fluid channels;

a second end extending out of said manifold for receiving a fluid fitting; and a second manifold flow passage defined by said open interior passage, the second manifold passage being fluidly coupled to a second set of said heat exchanger fluid channels;

wherein said manifold insert divides said heat exchanger into a first part corresponding to said first set of heat exchanger fluid channels and a second part corresponding to said second set of heat exchanger fluid channels, the first and second parts defining a two-pass flow path;

wherein said manifold insert has a first end disposed within a recessed area of a boss portion of a heat exchanger plate that forms said heat exchanger and defines a corresponding one of the heat exchanger fluid channels, the first end defining a sealing surface for closing an end of the annular manifold flow passage thereby preventing fluid communication between the annular manifold fluid passage and an adjacent one of the heat exchanger fluid channels, the first sealing end being recessed within the boss portion leaving the corresponding one of the heat exchanger fluid channels unobstructed.

13. The manifold insert as claimed in claim 12, wherein said first end comprises a flange surrounding and extending radially from an open end of the cylindrical body.

14. The manifold insert as claimed in claim 12, wherein said first end comprises a circumferential bead extending radially from the outer surface of said cylindrical body, the circumferential bead being spaced apart from said flanged end defining a gap therebetween for sealing a portion of said heat exchanger manifold.

15. A method of forming a two-pass heat exchanger comprising:

providing a heat exchanger core comprising:

a plurality of spaced apart heat exchanger plates defining a plurality of alternating first and second fluid channels therebetween, wherein each heat exchanger plate comprises a base portion; a peripheral wall extending from and surrounding the base portion, the peripheral wall of one heat exchanger plate sealing against the peripheral wall of the adjacent heat exchanger plate when said plates are stacked together in a nesting relationship; a pair of boss portions that project out of the plane of the base portion, each boss portion having a fluid opening formed therein; and a pair of fluid openings formed in the plane of the base portion; wherein the fluid openings in each of the boss portions of one plate align and mate with the fluid openings formed in the plane of the base portion of the adjacent plate, the boss portions spacing apart the adjacent plates;

a pair of first fluid manifolds in communication with said plurality of first fluid channels for directing a first fluid through said heat exchanger;

a pair of second fluid manifolds in communication with said second fluid channels for directing a second fluid through said heat exchanger;

providing a manifold insert having an elongated, cylindrical body extending between first and second ends, the manifold insert having a diameter less than the diameter of at least one of said manifolds in one of said pairs of manifolds;

arranging said manifold insert within the at least one of said manifolds, the first end of said manifold insert being recessed within a boss portion of a heat exchanger plate defining a corresponding fluid channel, the boss portion forming part of said manifold of said heat exchanger, the first end defining a sealing surface thereby dividing the heat exchanger core into a first part and a second part, the second end of the manifold insert extending outwardly from the heat exchanger core;

wherein the manifold insert defines an annular first manifold fluid passage between the at least one of said manifolds and the outer surface of said manifold insert, and a second manifold fluid passage within the open interior passage formed by the cylindrical body, the annular first manifold fluid passage being in fluid communication with the one of said plurality of first or second fluid channels in said first part, and wherein the second manifold fluid passage is in fluid communication with the one of said plurality of first or second fluid channels in said second part;

wherein said first end of said manifold insert disposed within the recessed area of said boss portion of a heat exchanger plate that forms said heat exchanger and defines a corresponding one of the heat exchanger fluid channels defines a sealing surface for closing an end of the annular manifold flow passage thereby preventing fluid communication between the annular manifold fluid passage and an adjacent one of the heat exchanger fluid channels, the first sealing end being recessed within the boss portion thereby leaving the corresponding one of the heat exchanger fluid channels unobstructed.

16. The method as claimed in claim 15, further comprising:

providing a divider plate within said heat exchanger core for dividing said heat exchanger core into said first part and said second part, the divider plate having:

a fluid opening formed therein with a diameter less than the diameter of the manifold; and a peripheral edge extending from said fluid opening for engaging the first end of said manifold insert;

wherein the divider plate and said manifold insert together form said annular manifold structure.

* * * * *